US005575129A

United States Patent [19]

Goto

[11] Patent Number: 5,575,129

[45] Date of Patent: Nov. 19, 1996

[54] CONNECTOR FOR TRUSS STRUCTURE

[75] Inventor: Yasuo Goto, Oita, Japan

[73] Assignee: Home Co., Ltd., Oita-ken, Japan

[21] Appl. No.: 330,673

[22] Filed: Oct. 28, 1994

[30] Foreign Application Priority Data

Oct. 30, 1993 [JP] Japan ..... 5-294289

[51] Int. Cl.[6] ..... E04C 5/03

[52] U.S. Cl. ..... 52/655.1; 52/656.9; 52/726.1; 52/563.2; 403/267; 403/268

[58] Field of Search ..... 52/655.1, 653.2, 52/656.9, 726.1, 726.2, 726.3; 403/267, 268, 405.1; 156/304.2, 381

[56] References Cited

U.S. PATENT DOCUMENTS

| | | | |
|---|---|---|---|
| 3,864,051 | 2/1975 | Reid | 52/565.9 X |
| 5,398,475 | 3/1995 | Kraus | 52/655.1 |
| 5,466,086 | 11/1995 | Goto . | |

FOREIGN PATENT DOCUMENTS

| | | | |
|---|---|---|---|
| 0311834 | 4/1989 | European Pat. Off. | 52/653.2 |

*Primary Examiner*—Carl D. Friedman
*Assistant Examiner*—W. Glenn Edwards

[57] ABSTRACT

It is an object of the present invention to provide a connector for truss having a high shearing resistance and a superior safety in which the connector can be inserted into and fixed in advance to the abutted surfaces of the structural members to be connected, adjustment of orientation of the connector is not needed, workability and installing workability can be remarkably improved and further the inserted and fixed connector can be prevented from being pulled when the connector is connected to the structural member. The connector of the present invention includes the flat-plate like connecting plate 2, a hollow tubular member 3 having one end fixed to each of both surfaces of the connecting plate 2 and opened at the other end, a branch pipe engage part 7 communicated from a side of the tubular member 3 facing to the connecting plate up to the hollow part, a hollow branch pipe 8 having the engage part 9 removably engaged with the branch pipe engage part 7 formed at at least one end thereof, and a fixing hole 12 formed at a predetermined part of the connecting plate 2.

9 Claims, 7 Drawing Sheets

FIG. 4-a
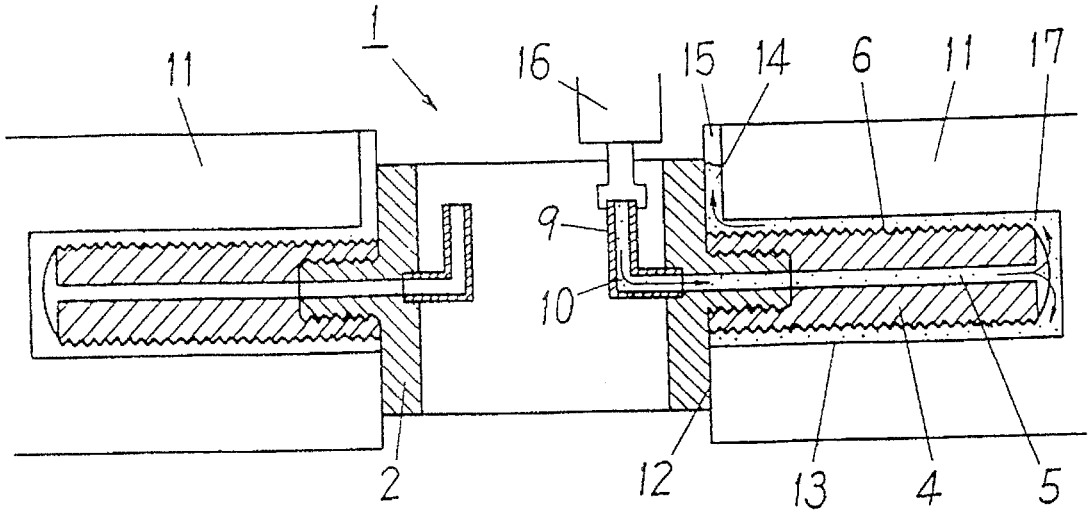
FIG. 4-b
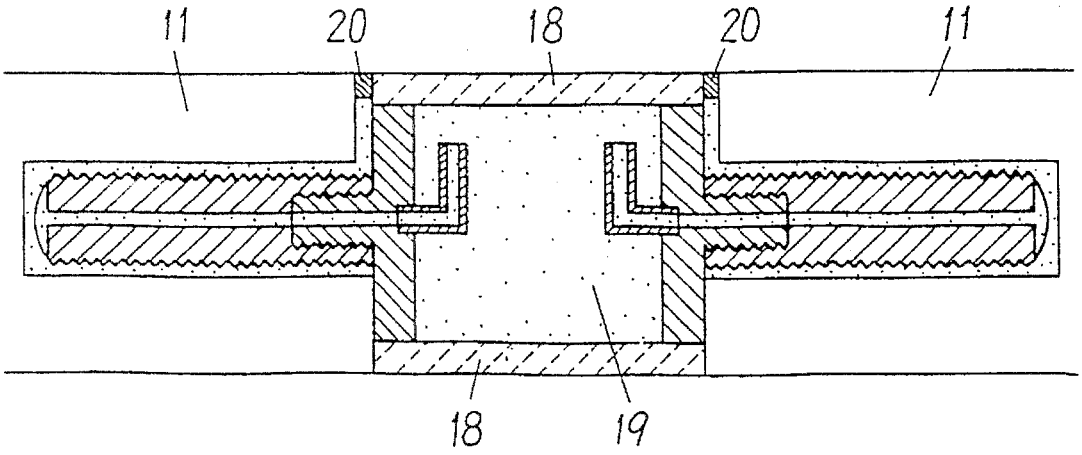

FIG. 8-a
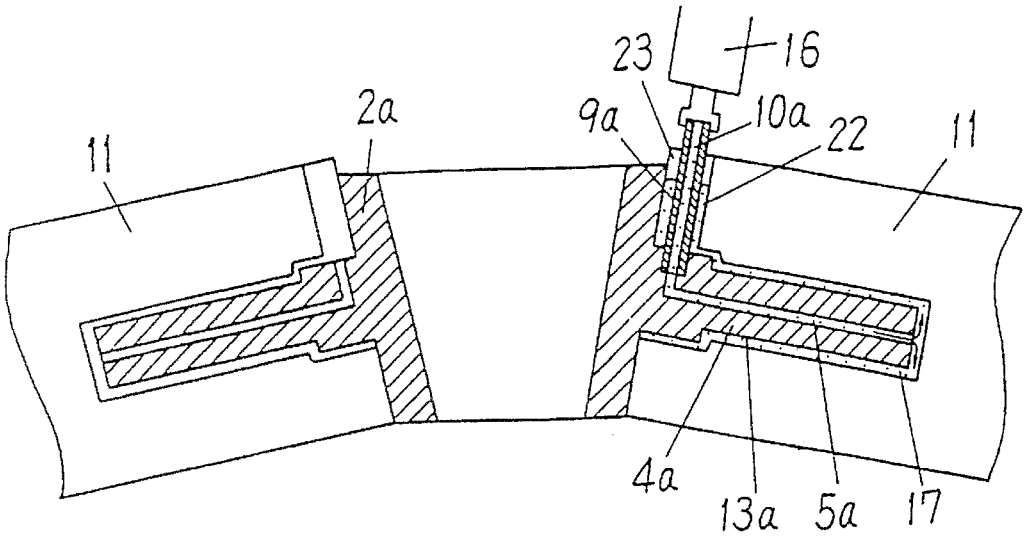
FIG. 8-b
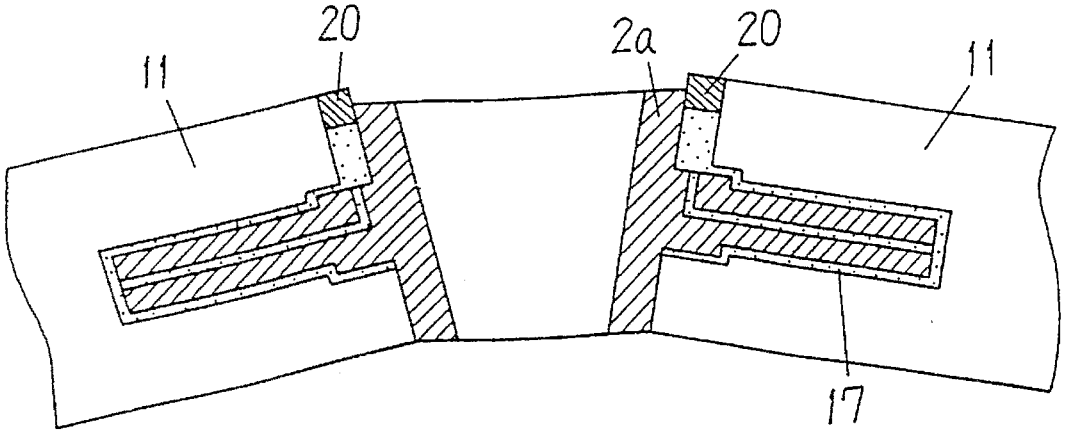

FIG. 9-a
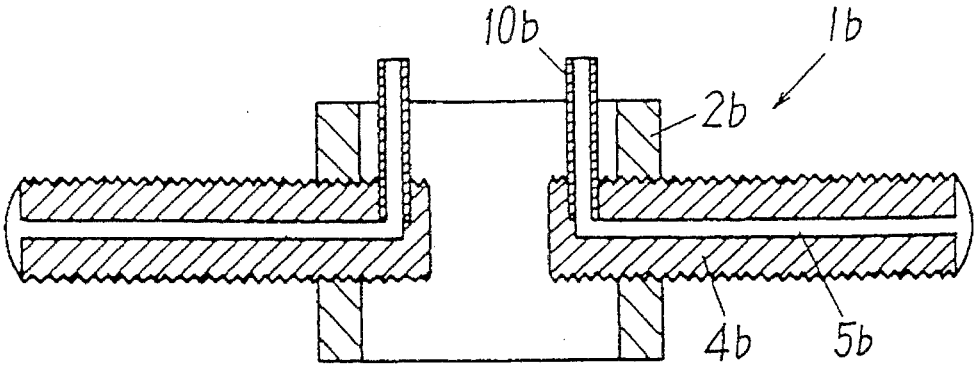
FIG. 9-b
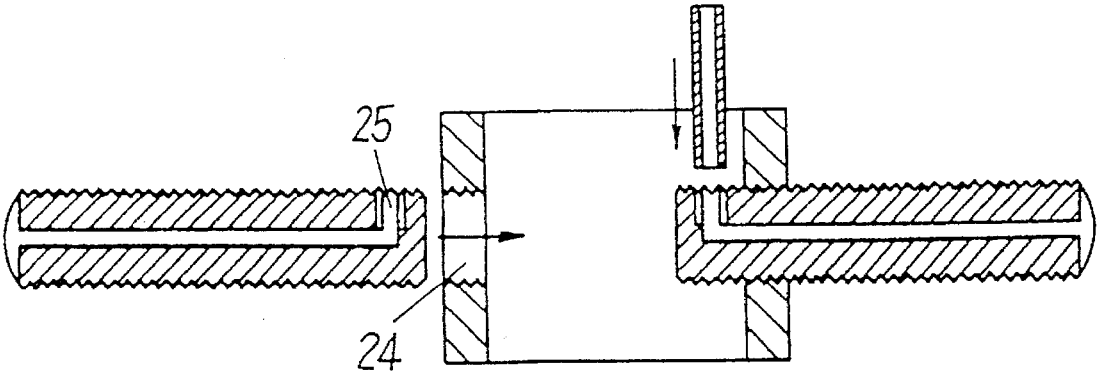

CONNECTOR FOR TRUSS STRUCTURE

BACKGROUND OF THE INVENTION

1. Field of the Invention

This invention relates to a connector for truss structure which is suitable for a connection of structural members in a wooden structure, in particular for a connection between the structural members in a truss structure.

2. Description of the Related Art

In recent years, there have been developed various kinds of structural laminated woods so as to apply some features of wood, artificially to improve the structural defects such as knots as found in natural materials and to get a heavy timber, long and large timber which is difficult to get from natural timber material. Along with this trend, it has been required to provide a connector for truss corresponding to a truss connection in the wooden structure.

The prior art connector for truss will be described as follows.

In the prior art, the connector for truss corresponding to the truss of the wooden structure has been used in such a manner that a bolt and nut are used for connecting the structural members to each other.

For example, ① the gazette of Japanese Patent Laid-Open No. Hei 4-41831 discloses a light-weight dome and a connector for the dome in which a pair of metallic connectors are welded in a radial spaced-apart relation to an outer circumference of a tube-like boss member, a wooden supporting member is held by a pair of metallic connectors and fastened and fixed with the bolts and nuts, and ② the gazette of Japanese U.M. Laid-Open No. Hei 4-13703 discloses a connector for connecting the wooden truss members by a method wherein an end surface of the wooden member is punched with a bolt embedding hole, a bolt is embedded into the bolt embedding hole, the bolt is integrally fixed to the wooden member with the adhesive agent and the bolt is fastened to a connector fitting with nut.

However, in the aforesaid prior art configuration, in particular ① had some problems that many parts such as bolts, nuts and washers were required for connecting the structural members, fixing work for the structural members was troublesome and its workability was lacked. In addition, the prior art had other problems that the fitting was large in size, its transporting characteristic was not satisfactory, and in particular its working at a high-elevated location was lack of safety.

Additionally, the prior art structure in which the wooden supporting members were fastened and fixed with bolts and nuts had some problems that its fastening force is lost in several years due to shrinkage of the wooden material to cause a certain looseness to be easily generated there and its physical strength was reduced.

Additionally, in ② it had some problems that it was necessary to insert and fix the bolts in the wooden member by adhesive agent in advance and in the case that the members were damaged during installing work or erroneous size occurred in the members, its accommodation for these accidents is difficult at site and its installing workability is not satisfactory. In addition, the prior art had other problems that confirmation whether or not adhesive agent for use in fixing the bolts is uniformly filled in the bolt embedding hole in the wooden member, positively adhered to and fixed to it can not be performed and this shows a certain problem in quality control. Further, the prior art had another problem that if the nut is too fastened when this wooden member is to be fixed to the connector, the adhesive agent adhering and fixing the bolt to the wooden member was easily damaged due to a pulling force of the bolt, and its safety in operation was not satisfactory.

SUMMARY OF THE INVENTION

The present invention aims at solving the aforesaid problems of the prior art and it is an object of the present invention to provide a connector for truss suitable for connecting structural members in a truss structure in which its looseness caused by shrinkage of wooden member is eliminated, a pouring of the adhesive agent is easily carried out, the structural members can be positively connected to each other, a complex connecting structure can be easily adapted at site, its workability, installing workability and reliability are remarkably improved, productivity of building is improved and its safety is superior.

In order to accomplish the aforesaid object, the present invention is comprised of the following components.

A connector for truss comprises a core fitting; a hollow tubular member having its base end fixed to a predetermined part of said core fitting and having its end opened; a branch pipe hole communicated from either the end part of the base part of said core fitting of said tubular member or its side part to said hollow part of said tubular member and punched; a branch pipe engage part formed at said branch pipe hole; and a branch pipe having an engage part formed at at least one end thereof removably engaged with said branch pipe engage part.

The core fitting of the connector for truss is made of metal such as iron, steel, alloy etc. of which shape is formed into a connecting shape of the connecting end surface of the structural member to be connected, such as of a tubular one with a section of substantial circle, substantial ellipse, substantial polygon or is of substantial cubic, substantial parellelpiped, substantial sphere, substantial cone. The tubular member to be embedded into and fixed to the structural member is fixed to or removably engaged with the surface to which the structural member is connected.

The core fitting may be made of the product having complex materials of synthetic resin and organic, non-organic fibers such as carbon fiber, boron fiber, glass fiber and metallic fiber molded to each other in addition to metal product, or may be of ceramics using cement etc. as well as its complex product and it is properly and selectively used in response to a size of the structural members to be connected or their installing location. These core member and tubular member may be integrally formed or separately formed from each other.

A shape of heavy timber of the tubular member may be substantial circle, substantial ellipse, or substantial polygon in reference to a size or a shape of structural members to be connected, its material quality may be of a single layer having the same material quality as that of the core fitting or of multi-layer structure of different material quality layers of 2 or more. With such an arrangement as above, the tubular member can be light in weight and a diameter of the tubular member or its strength can be controlled.

The adhesive agent pouring hollow part is formed in a longitudinal direction of a substantial central part of the tubular member from the end part up to the branch pipe engage part.

It is preferable that the projections, concave or convex parts formed on the outer surface of the tubular member may be of one in which the continuous projections or non-continuous projections are formed randomly or may act as buffer for adhesive agent flowed out of the other end of the tubular member of helical form etc. and the adhesive agent is filled in a clearance between an outer surface of the tubular member and a circumferential wall of a communication hole of the structural member to expand the adhering area and at the same time it is formed into such a shape as one in which an engaging effect can be applied. One or a plurality of projections may be formed or may not be formed at the end part of the projection or a returning flow end of the adhesive agent of the branch pipe in reference to an installing work or the kind of adhesive agent (one having a high viscosity). In addition, a width or depth of the concave or convex part of the helical groove etc. may be properly changed according to a viscosity of the adhesive agent.

A shape of the adhesive agent flowing-out side end of the tubular member may be of one of a bulged shape, flat shape or a concave shape and it is efficient to selectively apply its shape in reference to application or the kind of structural members. Further, if the end part of the tubular member for flowing out the adhesive agent is formed with a guiding part such as a groove for guiding the poured adhesive agent toward the outer surface or a recess, the adhesive agent can be smoothly guided to a space between the surface of the tubular member and a circumferential wall of the connecting hole and the pouring workability of the adhesive agent can be improved. The member engage part removably engaged with the tubular member against the core fitting is formed with a convex or concave or hole-like threaded fitting part at the connecting surface side of the structural member of the core fitting.

Additionally, the base part of the tubular member is formed with a concave or convex core engage part threadably engaged with the member engage part formed at the core fitting and removably engaged with it. A diameter size and a length of the tubular member fixed to or removably engaged with the connecting surface of the structural member of the core fitting or removably engaged with it may be varied in reference to a size or a shape of the structural members to be connected. The number of tubular members formed at the same connecting surface may be one or a plurality of members in response to a size of the structural member or a connecting structure. A hollow branch pipe for use in pouring adhesive agent to the hollow part of the tubular member is fixed to or removably engaged with a side or an end of the base part of the tubular member. The branch pipe is composed of a tubular member, its material quality is the same as that of or different from that of the tubular member and the branch pipe is engaged such that a hollow part of the tubular member is communicated with a hollow part of the branch pipe. A method for engagement may be carried out such that the engage part of the branch pipe and the engage part of the tubular member are formed with threaded holes so as to be threadably engaged to each other or the fitting part is formed to make an engage part by the fitting etc. In the case that the same connecting surface of the core fitting is formed with a plurality of tubular members, an engaging direction of the branch pipe may be changed upside down or changed in rightward or leftward direction. In the event that the branch pipe is engaged removably, the branch pipe is pulled out by releasing the engagement with the tubular member after pouring the adhesive agent. However, in the case that a length of the branch pipe is short and an embedding timber or a plug is inserted without any trouble, the branch pipe may be left as it is.

With such an arrangement as above, the metallic connector for truss in which the core fitting and the tubular member are integrally assembled in compliance with the connecting shape of the connecting part between each of the structural members is embedded and fixed, so that it is possible to improve remarkably a being stress, a tensile stress, a compression stress and a shearing stress and the like.

In addition, since a shape, a diameter and a length of the connector for truss can be freely changed, it is possible to accommodate for a connecting form of complex structural members. The connecting method is carried out such that the abutting surfaces of each of the structural members is merely formed with a connecting hole or a cutting part, the connector for truss is inserted and fixed, the adhesive agent is poured, so that its working steps can be quite simplified and also the number of working steps can be reduced. Since the fitting having a large number of complex parts is not used, it is possible to prevent damage or loss of material caused by wrong fitting and the like.

As described above, the present invention is constructed such that the connector for truss is coated by adhesive agent within the structural member, so salt damage or dew formation can be prevented and no decay occurs. In addition, since the adhesive agent is not exposed out to the surface, no decay caused by ultraviolet ray occurs and then the reliability of the connecting structure can be remarkably improved.

Tubular members having different shapes or different sizes which are removably fixed to the core fitting are connected in reference to a size or a shape of the structural members to be connected are connected, thereby the connector for truss can be easily manufactured at installing site and a strength of the connector can be artificially controlled.

Additionally, the core fitting is embedded with an embedded plug to cause the connector for truss to be prevented from being viewed from outside, resulting in that the structure can be changed into one having a well outer appearance and further an additive value of the structure can be improved.

At the time of occurrence of fire, the internal connector for truss is protected by carbonized film of timber and non-ignited filling material and no thermal deformation occurs in it, resulting in that falling of the building can be prevented, an escaping time can be assured and a safety in operation can be remarkably improved.

As described above, it is possible to realize the superior connector for truss by a quite simple structure under a combination of adhesive agent and connector which has a strong rigidity and yield strength, an installing workability, labour saving and streamlining of the work can be remarkably improved.

BRIEF DESCRIPTION OF THE DRAWINGS

FIG. 4-*a* is a sectional view of a substantial part showing one example when the truss connection is carried out by using the connector for truss constructed in accordance with the first preferred embodiment of the present invention.

FIG. 4-*b* is a sectional view of a substantial part showing one example after installing a truss connection by using a connector for truss in the first preferred embodiment of the present invention.

FIG. 8-*a* is a sectional view of a substantial part showing one example when a truss connection is carried out by using the connector for truss in the second preferred embodiment.

FIG. 8-*b* is a sectional view of a substantial part showing one example after installing of the truss connection by using the connector for truss in the second preferred embodiment of the present invention.

FIG. 9-*a* is a sectional view of a substantial part of the connector for truss in the third preferred embodiment of the present invention.

FIG. 9-*b* is a sectional view of a substantial part of the process of assembling the connector for truss in the third preferred embodiment of the present invention.

DESCRIPTION OF THE PREFERRED EMBODIMENTS

Embodiment 1

Figure 1:
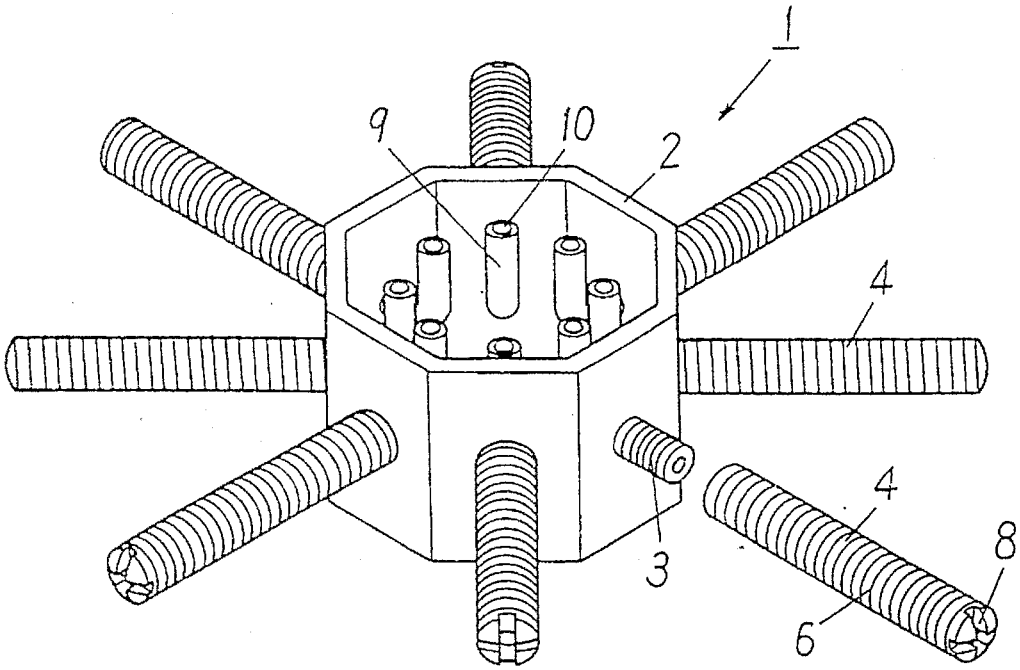
FIG. 1 is an entire perspective view of a connector for truss in a first preferred embodiment of the present invention.

Referring now to the drawings, one preferred embodiment of the present invention will be described as follows.

Figure 2:
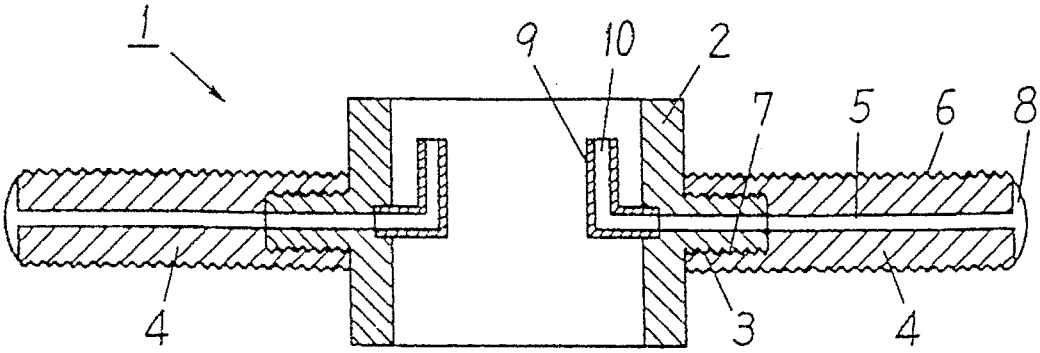
FIG. 2 is a sectional view of a substantial part of the connector for truss in the first preferred embodiment of the present invention.

FIG. 1 is an entire perspective view showing a connector for truss in the first preferred embodiment of the present invention. FIG. 2 is a sectional view of a substantial part of a connector for truss in the first preferred embodiment of the present invention.

1 denotes a metallic connector for truss in which the tubular member is removably connected to the core fitting, the hollow part is communicated with it and engaged; 2 denotes a metallic core fitting having an octagonal shape; 3 denotes a convex hollow member engage part threadably formed at an outer wall surface of the core fitting 2, threadably engaged with the tubular member; 4 denotes a metallic hollow round bar-shaped tubular member; 5 denotes a hollow part for pouring an adhesive agent formed in a longitudinal direction of a substantial central part of the tubular member 4 and opened at both ends thereof; 6 denotes a concave or convex part helically formed at the surface of the tubular member 4; 7 denotes a concave core engage part helically formed at the base part of the tubular member 4 and threadably engaged with the member engage part 3 formed in the core fitting 2; 8 denotes an adhesive agent flowing-out side end of the tubular member 4 formed in a bulged state and formed with a cross-shaped guide groove at its top part; 9 denotes an L-shaped hollow branch pipe fixed to the inner wall surface of the core fitting 2 while being communicated with the hollow part of the member engage part 3; and 10 denotes a branch pipe hollow part communicated with the hollow part 5 of the tubular member 4 through the hollow part of the member engage part 3 formed at the branch pipe 9.

A method for connecting the structural members will be described in reference to the connector for truss in a first preferred embodiment of the present invention constructed as described above.

Working Example 1

Figure 3:
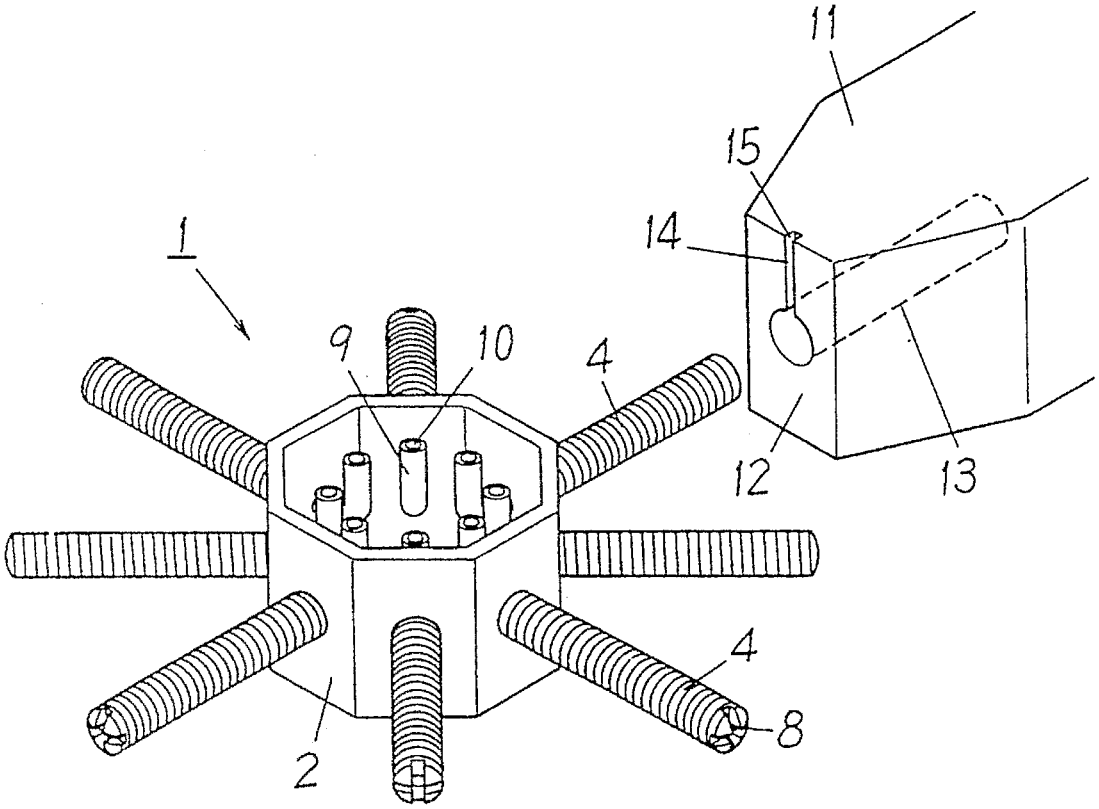
FIG. 3 is a perspective view of a substantial part showing one example of a truss connection using the connector truss in the first preferred embodiment of the present invention.

FIG. 3 is a perspective view of a substantial part showing one example of a truss connection using the connector for truss in the first preferred embodiment of the present invention. FIG. 4-*a* is a sectional view of a substantial part showing one example during a truss connection work using the connector for truss in the first preferred embodiment of the present invention. FIG. 4-*b* is a sectional view of a substantial part showing one example after installing the truss connection using a connector for truss in the first preferred embodiment of the present invention.

1 denotes a connector for truss; 11 denotes a structural member composed of a laminated wood for performing a truss connection; 12 denotes a connecting surface of the structural member 11; 13 denotes a connecting hole formed by a pre-cut system in advance, or formed at the connecting surface 12 of the structural member 11 in a size slightly larger than a diameter of the tubular member 4 and in a depth in which the tubular member 4 can be embedded at an installing site; 14 denotes an adhesive agent visual confirming groove cut and formed at the abutting surface of the connecting hole 13 to perform a visual confirmation of the returned flow of the adhesive agent; 15 denotes an opening of the adhesive agent visual confirming groove 14; 16 denotes an adhesive agent pouring gun; 17 denotes adhesive agent of epoxy or polyurethane resin system poured from the branch pipe 9, passing through the hollow part 5 of the tubular member 4, and filled until its returning flow is visually confirmed at the opening 15 of the adhesive agent visual confirming groove 14 while filling the outer surface of the tubular member 4 and the inner wall of the connecting hole 13; 18 denotes a buried wood plug for embedding the core fitting after truss connection; 19 denotes a filling material composed of non-burned material such as asbestos filled in the inner clearance of the core fitting 2 in the case that the core fitting 2 is embedded; and 20 denotes a plug for applying a lid to the opening 15 of the adhesive agent visual confirming groove 14 and making it in flush with the structural member.

The installing work of the preferred embodiment is carried out at first in such a manner that the structural member 11 formed with the connecting hole 13 and the adhesive agent visual confirming groove 14 is abutted against the core fitting 2, the tubular member 4 is inserted into and fixed to the connecting hole 13, and the structural member 11 is pulled toward the core fitting 2 by a support jig (not shown in a figure) and the like and temporarily fixed. The temporarily fixing has been continued until the adhesive agent had turned to caking and the connection had been completed.

Then, the adhesive agent pouring gun 16 is installed at the opening of the branch pipe 9, the adhesive agent 17 is filled in the connecting hole 13 through the hollow part 5 of the tubular member 4 until the returning-back flow of the adhesive agent 17 is visually confirmed at the opening 15 of the adhesive agent visual confirming groove 14 of the structural member 11. As shown in FIG. 4-*a*, the adhesive agent 17 is poured as indicated by an arrow from the branch pipe hollow part 10, passes through the hollow part 5 of the tubular member 4 and fills the clearance between the surface of the tubular member 4 and a circumferential wail of the connecting hole 13. In this case, a channeling or a short pass of the adhesive agent 17 is prevented under a buffering effect of the concave or convex part 6 at the surface of the tubular member 4, the adhesive agent 17 is filled in the clearance without leakage.

In addition, as the feeding of the adhesive agent 17 is continued, it can be confirmed visually that the adhesive agent 17 rises up while filling the clearance of the adhesive agent visual confirmation groove 14, resulting in that glue non-uniformity can be prevented. Upon visual confirmation of filling of the adhesive agent 17 in the opening 15 of the adhesive agent visual confirming groove 14, pouring of the adhesive agent 17 is terminated. Then, as shown in FIG. 4-*b*, after filling the clearance inside the core fitting 2 with non-combustible filling material 19 such as asbestos, the upper and lower openings of the core fitting 2 are embedded with buried plugs 18 to be in flush with the structural member 11. In addition, the opening 15 of the adhesive agent visual confirming groove 14 is also embedded with the plug 20 to make it in flush with the structural member. If the buried plug 18 and the plug 20 are made of the same material quality as that of the structural member 11, no irregular outer appearance occurs when they are made in flush with the structural member 11 and they can be made in flush with the structural member 11.

As described above, according to the present preferred embodiment, since the shape or size of the tubular member connected to the core fitting in compliance with a size or shape of the structural members to be connected can be freely selected at an installing site, their workability can be remarkably improved. In addition, the tubular member is integrally connected to the core fitting, a connector for truss can be integrally embedded and fixed between each of the structural members to be connected, so that its bending, tensile, compression and shearing stresses can be remarkably improved. Additionally, since the entire connector for truss is embedded, an internal part is protected by carbonized film and non-combustible filling material at the surface of the wooden member at the time of fire, the connector for truss is prevented from being melted, a structural strength can be maintained, falling of the building can be prevented and its safety characteristic can be improved.

Preferred Embodiment 2

Figure 5:
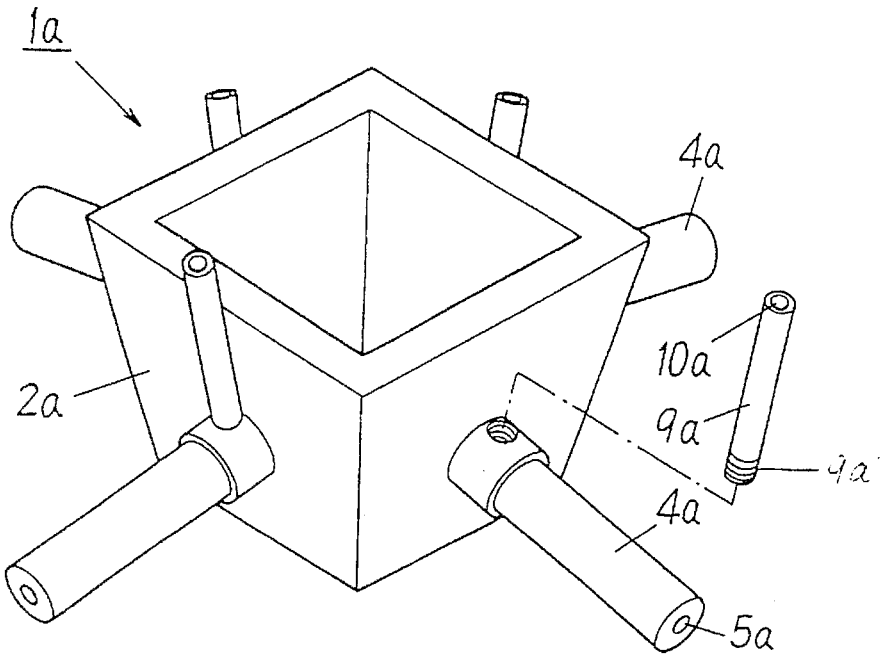
FIG. 5 is an entire perspective view showing a connector for truss in a second&referred embodiment of the present invention.
Figure 6:
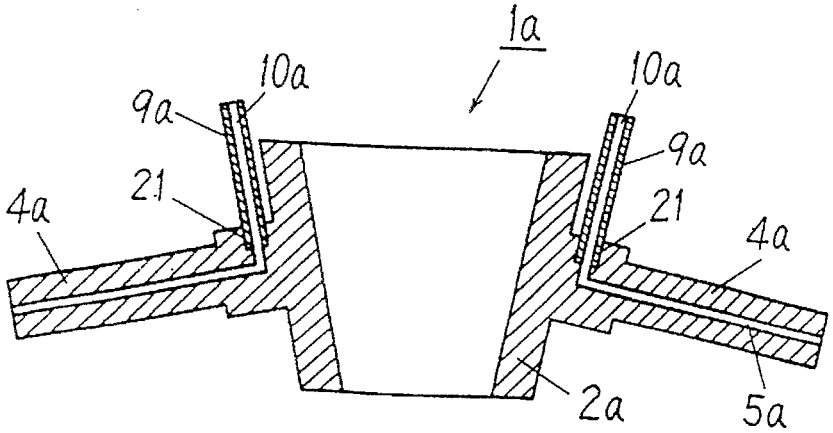
FIG. 6 is a sectional view of a substantial part of a connector for truss in the second preferred embodiment of the present invention.

FIG. 5 is an entire perspective view showing a connector for truss in the second preferred embodiment of the present invention. FIG. 6 is a sectional view of a substantial part of the connector for truss in the second preferred embodiment of the present invention.

The difference between the connector for truss 1*a* in the second preferred embodiment of the present invention and that in the first preferred embodiment of the present invention is that the parts consist in the fact that a shape of the core fitting 2*a* is of a trapezoid tubular shape of inverse quadrangular pyramid, a base part of the tubular member 4*a* is welded to the core fitting 2*a*, and the base part of the tubular member 4*a* is provided with the branch pipe engage part 21 removably engaged with the engage part 9*a*' formed at one end of the hollow rod-like branch pipe 9*a*.

In this case, although the surface of the tubular member 4a is provided with a step part at its base part, it may be of a concave or convex shape so as to improve a buffer effect of the adhesive agent.

A method for connecting the structural members will be described in reference to the connector for truss in the second preferred embodiment of the present invention constructed as described above.

Work Example 2

Figure 7:
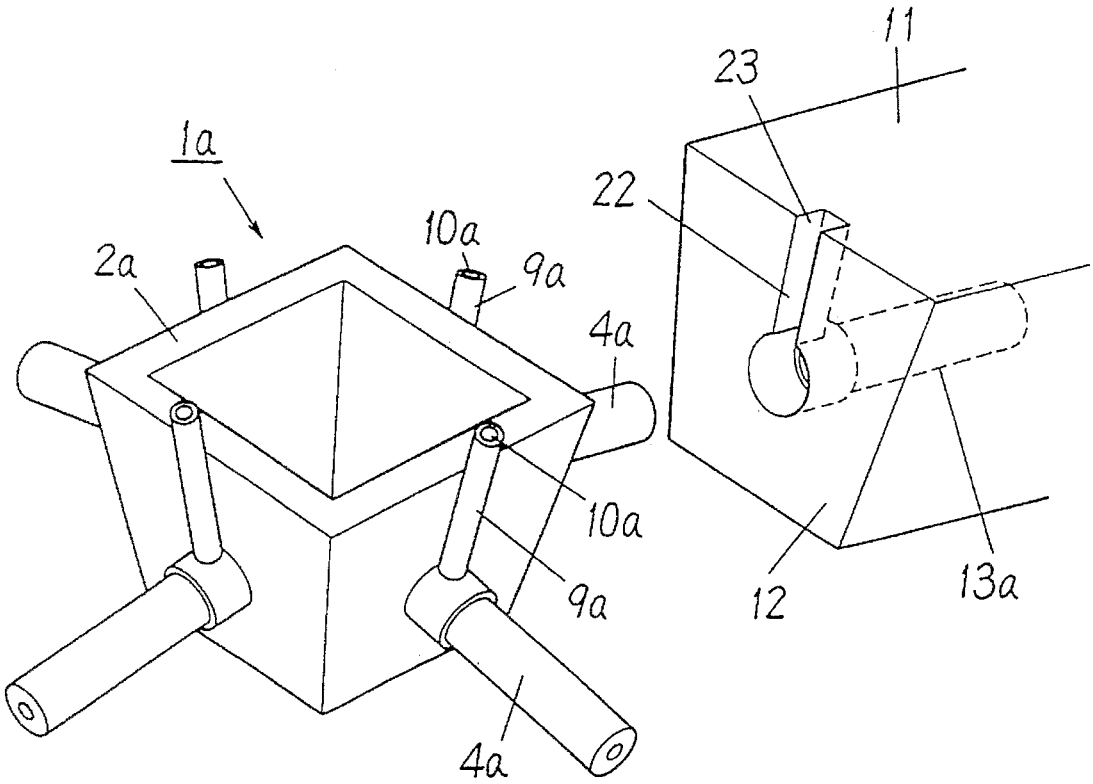
FIG. 7 is a perspective view of a substantial part showing one example of a truss connection by using a connector for truss in the second preferred embodiment of the present invention.

FIG. 7 is a perspective view of a substantial part showing one example of a truss connection using the connector for truss in the second preferred embodiment of the present invention. FIG. 8-*a* is a sectional view of a substantial part showing one example when a truss connection is worked by using the connector for truss in the second preferred embodiment of the present invention. FIG. 8-*b* is a sectional view of a substantial part showing one example after a truss connection is worked by using the connector for truss in the second preferred embodiment of the present invention.

22 denotes a branch pipe installing groove cut and formed for installing the branch pipe 9*a* at the abutting surface of the connecting hole 13*a* formed at the structural member 11. 23 denotes an opening of the branch pipe installing groove 22.

The work of the present preferred embodiment is carried out at first in such a manner that the abutting surface 12 of the structural member 11 to perform a truss connection is formed with a connecting hole 13*a*, under an operation of a drill and the like, having a diameter slightly larger than a diameter of the tubular member 4*a* and having a depth where the tubular member 4*a* is embedded.

Then, the connecting surface of the connecting hole 13*a* is formed with a branch pipe installing groove 22 for installing the branch pipe 9*a*. Then, the structural member 11 formed with the connecting hole 13*a* and the branch pipe installing groove 22 is abutted against the core fitting 2*a* to which the branch pipe 9*a* is engaged. At this time, the tubular member 4*a* is inserted into and fixed to the connecting hole 13*a*, and the branch pipe 9*a* is fitted to the branch pipe installing groove 22. In addition, applying the adhesive agent to the connecting surface 12 of the structural member and/or the abutting surface of the core fitting enables the connection of the structural member to be more rigidly carried out.

Then, a temporary fixing is carried out while the structural member 11 is being pulled toward the connector for truss 1*a* by using a support jig such as a turn buckle, strap bolt and the like in the same manner as the working example 1.

Then, the adhesive agent pouring gun 16 in installed at the opening of the branch pipe 9*a*, and the adhesive agent 17 is filled in the connecting hole 13*a* until a returning flow of the adhesive agent 17 is confirmed at the opening 23 of the branch pipe installing groove 22 formed at the structural member 11 through the hollow part 5*a* of the tubular member 4*a*. As shown in FIG. 8-*a*, the filling of the adhesive agent 17 is poured from the branch pipe hollow part 10*a*, passes through the hollow part 5*a* of the tubular member 4*a* and fills a clearance between the surface of the tubular member 4*a* and the circumferential wall of the connecting hole 13*a*. In this case, channeling or short pass of the adhesive agent 17 is prevented under a buffer effect at the step of the surface of the tubular member 4*a* and then the adhesive agent 17 is filled in the clearance without any leakage. In addition, continuation of pouring of the adhesive agent 17 enables visual confirmation of rising up of the adhesive agent 17 while filling the clearance of the branch pipe installing groove 22 to be attained and thus glue non-uniformity can be prevented from being generated. Upon visual confirmation of the adhesive agent 17 at the opening 23 of the branch pipe installing groove 22, pouring of the adhesive agent 17 is stopped, the branch pipe 9*a* is pulled out and then the plug 20 is embedded into the opening 23 of the branch pipe installing groove 22 in flush therewith.

If necessary, it is also possible to fill non-combustible material such as asbestos in the core fitting 2*a*, plugs are embedded in the upper opening and lower opening of the core fitting 2*a*, they are made in flush with the structural member 11 so as to enable them to be integrally assembled with the structural member 11.

As described above, according to the present preferred embodiment, a shape of the core fitting is changed in response to a shape of the connecting end surface of the structural member to be connected for truss to enable a truss connection having a complex cubic structure to be easily accommodated.

In addition, the tubular member welded and fixed to the core fitting can be integrally embedded and fixed between each of the structural members to be connected, so that bending, tensile, compressive and shearing stresses etc. can be remarkably improved.

Preferred Embodiment 3

FIG. 9-*a* is a sectional view of a substantial part of a connector for truss in the third preferred embodiment of the present invention.

Some features of the connector 1*b* for truss in the third preferred embodiment differing from those of the connector for truss of the first preferred embodiment consist in the fact that there is provided a hole 24 for a tubular member having a threaded groove at a substantial central part of each of side walls of a core fitting 2*b* with a polygonal section for removably and threadably fixing the tubular member 4*b* and another fact that the tubular member is provided with a threaded groove formed at at least a circumferential wall of the base part and an engage part 25 for a branch pipe where a branch pipe 9*b* is removably or fittingly fixed to the circumferential wall at the base part.

An assembling method for the connector for truss of the third preferred embodiment constructed as described above will be described as follows.

FIG. 9-*b* is a sectional view of a substantial part for illustrating an assembling step of the connector for truss of the third preferred embodiment.

The core fitting 2*b* formed into a polygonal tubular form having a triangle, a square and a hexagon in section corresponding to a building site is prepared. Then, the tubular member 4*b* having a diameter coinciding with that of the hole 24 for the tubular member punched at one to two locations at the central part of each of the side walls of the core fitting 2*a* and the branch pipe 9*b* are prepared. Then, a predetermined length of the threaded groove at the base part of the tubular member 4*b* is threadably engaged with the threaded groove of the hole 24 for the tubular member and the threaded groove of the base part of the branch pipe 9*b* is installed at the threaded groove formed at an inside part of the engage part 25 for the branch tube. Then, they are worked in the same manner as that of the first preferred embodiment.

As described above, according to the preferred embodiment, since the core fitting, the tubular member and the branch tube are freely decomposed and assembled, respectively, they can be decomposed and separately stored or transported and they may be assembled at the building site during their work, so they are superior in their storing characteristic and transporting characteristic. In addition, since the tubular member is threadably engaged with the core fitting, adjustment can be carried out in response to a depth of the connecting hole of the structural member and a filling efficiency can be increased.

In the case that a thickness of the core fitting is thin, it may also be possible to arrange a reinforcing member such as a bolt or the like at an inside part of the core fitting of the hole for the tubular member.

What is claimed is:

1. A truss connector comprising a core fitting, a hollow tubular member having a base part fixed to a predetermined part of said core fitting and having a distal end opened, a branch pipe communicating with said tubular member and further comprising engaging means formed where said branch pipe communicates with said tubular member wherein said branch pipe is removably engageable with said tubular member.

2. A connector for truss according to claim 1 in which the surface of said tubular member is formed with projections, concave or convex parts.

3. A connector for truss according to claim 1 in which said branch pipe is fixed to said engaging means.

4. A truss connector according to claim 1 wherein a distal end of said connecting member has a radial passage extending from said tubular section said radial passage providing a passage for adhesive to flow from said tubular member.

5. The truss connector as recited in claim 4 wherein said radial passage comprises a groove.

6. The truss connector as recited in claim 1 wherein said branch pipe connects with said tubular member within said core fitting.

7. The truss connector as recited in claim 1 wherein said tubular member is threadably engaged in said core fitting.

8. A method of attaching a truss to a connector said connector having a core and a tubular member extending radially from said core and having a proximal and distal end, said method comprising inserting said tubular member into a bore hole provided in said truss, introducing adhesive into said tubular member near said proximal end whereby adhesive is caused to flow through said tubular member and out said distal end and flow within a space between the exterior surface of said tubular member and the inner wall of said bore hole.

9. A connector for a truss according to claim 1 further comprising a convex member engage part formed at a predetermined part of said core fitting, having said tubular member removably engaged therewith, said core fitting further comprising a convex formed core engage part engageable at the base part of said tubular member.

* * * * *